US009851068B2

(12) United States Patent
Dellock et al.

(10) Patent No.: US 9,851,068 B2
(45) Date of Patent: Dec. 26, 2017

(54) LIGHT-EMITTING DIODE LAMPS WITH THERMALLY CONDUCTIVE LENSES

(71) Applicant: Ford Global Technologies, LLC, Dearborn, MI (US)

(72) Inventors: Paul Kenneth Dellock, Northville, MI (US); Stuart C. Salter, White Lake, MI (US); Talat Karmo, Waterford, MI (US); Michael Musleh, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 74 days.

(21) Appl. No.: 15/144,983

(22) Filed: May 3, 2016

(65) Prior Publication Data

US 2017/0321864 A1 Nov. 9, 2017

(51) Int. Cl.
*F21S 2/00* (2016.01)
*F21S 8/10* (2006.01)

(52) U.S. Cl.
CPC ..... *F21S 48/328* (2013.01); *F21S 48/215* (2013.01); *F21S 48/238* (2013.01)

(58) Field of Classification Search
CPC ..... F21S 48/22; F21S 48/215; F21S 48/238
See application file for complete search history.

(56) References Cited

U.S. PATENT DOCUMENTS 6,921,927 B2 7/2005 Ng et al.
8,324,641 B2 * 12/2012 Yan ..... H01L 33/56 257/100
8,519,603 B2 8/2013 Yang et al.
2006/0256439 A1 * 11/2006 Yukawa ..... C08J 7/04 359/534

FOREIGN PATENT DOCUMENTS

CN 102997070 A 3/2013
JP 2005294334 A 10/2005
KR 20130070043 A 6/2013

OTHER PUBLICATIONS

Toshiba, Thermal Managements and Measurements for LED Lamps, Toshiba LED Application Notes, Nov. 19, 2015, 10 pages, Rev.1.1.

* cited by examiner

*Primary Examiner* — Christle I Marshall
(74) *Attorney, Agent, or Firm* — Jason Rogers; Price Heneveld LLP

(57) ABSTRACT

A light-emitting diode (LED) lamp is provided that includes: an LED source coupled to a housing; and a lens over the source and coupled to the housing. The lens, or a portion of the lens, includes a plurality of glass beads, each having a metal-containing coating (e.g., a coating comprising at least one of Ni, Al, Cu, In and brass) and dispersed in a polymeric matrix (e.g., an acrylic or a polycarbonate). Further, the lens has a thermal conductivity of at least about 2 W/m*K and an optical transmissivity of at least 80%.

20 Claims, 3 Drawing Sheets

LIGHT-EMITTING DIODE LAMPS WITH THERMALLY CONDUCTIVE LENSES

FIELD OF THE INVENTION

The present invention generally relates to light-emitting diode (LED) lamps and assemblies and, more particularly, to LED lamps and assemblies with light-diffusing, thermally conductive lenses for vehicular applications.

BACKGROUND OF THE INVENTION

Modern vehicles include various LED lamps and lamp assemblies (e.g., puddle lamps) that do not require highly-specialized or otherwise regulated, output light patterns of other vehicular lighting elements, some of which require the production of a regulated light pattern (e.g., headlamps). These LED lamps and assemblies are more energy-efficient than earlier halogen and incandescent designs. Nevertheless, these LED lamps and assemblies can be limited by light intensity in view of power requirements, thermal management and vehicular weight considerations.

For example, vehicular lamps and lamp assemblies with high-powered LED light sources are often configured with heat sinks to dissipate and control heat generated from the LED sources. Control of heat generated by LED sources is important in preserving the long-life capability of these light sources, and also ensuring that the other lamp components (e.g., housing, lens, etc.) are not degraded by the heat generated from the LED sources. These heat sinks are usually fabricated from die-cast metals and alloys or extruded aluminum. As such, the heat sinks add to the overall size of the LED lamp and increase the weight of the LED lamps and assemblies.

Another issue with relying on heat sinks to dissipate heat in vehicular lamps and assemblies with LED sources is that the boards employed to mount the LED sources often reduce the effectiveness of the heat sink. In many cases, the boards employed to mount the LED sources do not effectively transmit heat via thermal conduction. Often the boards are fabricated from ceramic or polymeric materials with relatively low thermal conductivity values.

Accordingly, there is a need for light-emitting diode (LED) lamps and assemblies, particularly for vehicular applications, that can more effectively manage heat, while not significantly increasing packaging size, weight, cost and/or light production efficiency.

SUMMARY OF THE INVENTION

According to one aspect of the present invention, a light-emitting diode (LED) lamp is provided that includes: an LED source coupled to a housing; and a lens over the source and coupled to the housing. The lens includes a plurality of glass beads, each having a metal-containing coating and dispersed in a polymeric matrix. Further, the lens has a thermal conductivity of at least about 2 W/m*K and an optical transmissivity of at least 80%.

According to another aspect of the present invention, a light-emitting diode (LED) lamp is provided that includes: an LED source coupled to a housing; and a lens over the source and coupled to the housing. Further, a portion of the lens comprises a plurality of glass beads, each having a metal-containing coating and dispersed in a polymeric matrix. In addition, the lens has a thermal conductivity of at least about 2 W/m*K and an optical transmissivity of at least 80%.

According to a further aspect of the present invention, a lens for a light-emitting diode (LED) lamp is provided that includes: a lens for an LED source that includes glass beads dispersed in a polymeric matrix, the beads including a metal-containing coating having a thickness from about 250 to 750 Angstroms and at least one of Ni, Al, Ag, Cu, In and brass. Further, the lens has a thermal conductivity of at least about 2 W/m*K and an optical transmissivity of at least 80%.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
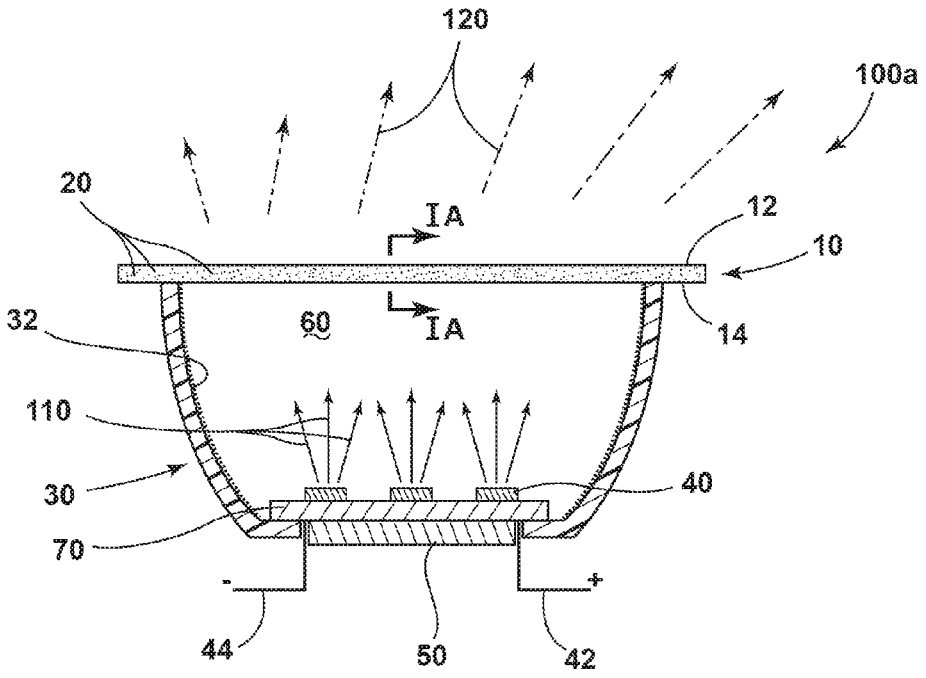
FIG. 1 is a side, cross-sectional schematic view of a light-emitting diode lamp according to an aspect of the disclosure.
Figure 2:
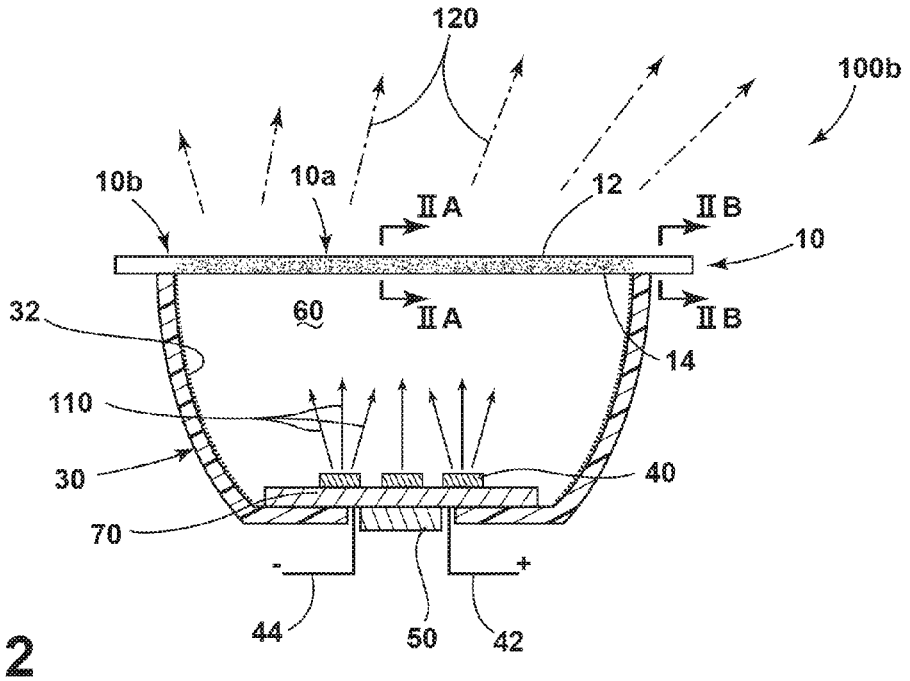
FIG. 2 is a side, cross-sectional schematic view of a light-emitting diode lamp according to another aspect of the disclosure.

For purposes of description herein, the terms "upper," "lower," "right," "left," "rear," "front," "vertical," "horizontal," "interior," "exterior," and derivatives thereof shall relate to the invention as oriented in FIGS. 1 and 2. However, the invention may assume various alternative orientations, except where expressly specified to the contrary. Also, the specific devices and assemblies illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Described in this disclosure are light-emitting diode (LED) lamps and lamp assemblies with thermally conductive lenses. Generally, embodiments of these lamps and assemblies in the disclosure effectively manage or otherwise assist in the management of heat from the LED sources, while not significantly increasing packaging size, weight, cost and/or light production efficiency. Among other applications, these LED lamps and assemblies can be employed in various vehicular applications including but not limited to mirror puddle lamps, door puddle lamps, turn signals, dome lamps, footwell lamps, interior courtesy lamps, vanity lamps, center high mount stop lamps (CHMSLs), daytime running lamps (DRLs), glove box lamps, and others.

Referring to FIG. 1, a light-emitting diode (LED) lamp 100*a* is depicted in schematic form. The LED assembly

100*a* includes one or more LED sources 40, each coupled to a housing 30 through a board 70. As depicted in FIG. 1 in exemplary fashion, the housing 30 can optionally include a reflective layer 32. Further, the board 70 includes positive and negative electrodes 42, 44, each electrically coupled to the sources 40 and a power source (not shown). In certain aspects, the power source is coupled to a controller and/or manual switch (not shown), configured to control the operation of the LED sources 40. Further, the board 70 is optionally placed in direct contact with a heat sink 50. As also shown in exemplary form in FIG. 1, the LED lamp 100*a* includes a lens 10 that is situated over the sources 40 and the board 70, and also coupled to the housing 30. Accordingly, the lens 10, housing 30, board 70 and LED sources 40 define an interior 60 within the LED lamp 100*a*. The interior 60 of the LED lamp 100*a* can be void space containing air or an inert atmosphere (e.g., argon gas, nitrogen gas, helium gas and combinations of the same). In certain embodiments, the interior 60 can be a polymeric seal to add in the protection of the LED sources 40, preferably with a very high optical transmissivity of at least 90%. The lens 10 includes an exterior primary surface 12 and an interior primary surface 14 facing the interior 60. Further, the lens 10 includes a plurality of glass beads 20, each individual bead 22 having a metal-containing coating 26 and dispersed a polymeric matrix 18 (see FIGS. 1A and 3).

Still referring to FIG. 1, the LED lamp 100*a* transmits a light pattern 120 that originates from incident light 110 from the LED sources 40. More particularly, the LED sources 40 produce incident light 110 that travels through the lens 10, scatters within the lens 10, and then exits the lens 10 as light pattern 120. In addition, the sources 40 of the LED lamp 100*a* generate heat that is transmitted via conductive and/or radiative mechanisms out of the lamp 100*a*. More particularly, heat from the sources 40 is conducted through the board 70 and into the heat sink 50. Heat from the sources 40 is also conducted through the housing 30. Finally, a significant portion of the heat generated by the sources 40 is transmitted through the lens 10 and into the surrounding environment.

Figure 1A:
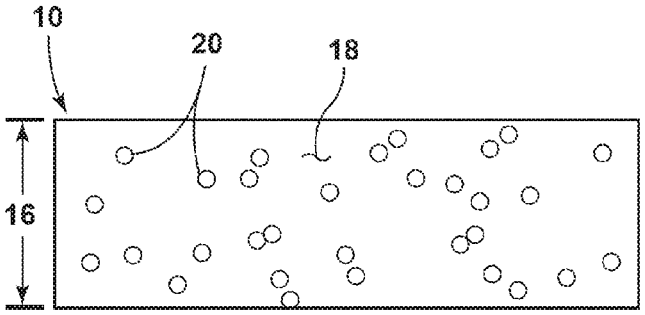
FIG. 1A is an enlarged, cross-sectional schematic view of the lens of the lamp depicted in FIG. 1 at line IA-IA.

Referring again to the LED lamp 100*a* depicted in FIG. 1, the lens 10 exhibits a thermal conductivity of at least about 0.17 W/m*K, at least as high as most polymeric materials suitable for use as matrix 18 (see FIG. 1A). In a preferred aspect of the disclosure, the lens exhibits a thermal conductivity of at least 1 W/m*K, more preferably a thermal conductivity of at least 2 W/m*K, and even more preferably a thermal conductivity of at least 3 W/m*K. For example, the lens 10 can exhibit a thermal conductivity of about 0.17 W/m*K, 0.2 W/m*K, 0.3 W/m*K, 0.4 W/m*K, 0.5 W/m*K, 0.6 W/m*K, 0.7 W/m*K, 0.8 W/m*K, 0.9 W/m*K, 1 W/m*K, 1.1 W/m*K, 1.2 W/m*K, 1.3 W/m*K, 1.4 W/m*K, 1.5 W/m*K, 1.6 W/m*K, 1.7 W/m*K, 1.8 W/m*K, 1.9 W/m*K, 2.0 W/m*K, 2.1 W/m*K, 2.2 W/m*K, 2.3 W/m*K, 2.4 W/m*K, 2.5 W/m*K, 2.6 W/m*K, 2.7 W/m*K, 2.8 W/m*K, 2.9 W/m*K, 3.0 W/m*K, and all thermal conductivity values between these values.

Referring again to the LED lamp 100*a* depicted in FIG. 1, the lens 10 exhibits an optical transmissivity (i.e. in the visible spectrum) of at least 80%. In a preferred aspect of the disclosure, the lens 10 exhibits an optical transmissivity of at least 85%. Even more preferably, the lens 10 exhibits an optical transmissivity of at least 90% in certain embodiments. For example, the lens 10 can exhibit an optical transmissivity of about 80%, 81%, 82%, 83%, 84%, 85%, 86%, 87%, 88%, 89%, 90%, and all optical transmissivity values between these values.

More generally, the foregoing thermal conductivity and optical transmissivity properties of the LED lamp 100*a*, and more particularly the lens 10, reflect a balance of high thermal conductivity levels and acceptable optical transmissivity levels for various applications. In particular, the thermal conductivity level of the lens 10 is relative to, and generally higher than, the thermal conductivity values of typical polymeric lens materials (i.e., typically 0.17 to 0.19 W/m*K for acrylic lenses and typically 0.19 to 0.22 for polycarbonate lenses). Further, the optical transmissivity levels of the lens 10 are comparable to the transmissivity levels of lenses typically employed in vehicular lamps and lamp assemblies that do not require highly-specialized or otherwise regulated, output light patterns. Accordingly, various embodiments of the LED lamp 100*a* described in, or otherwise consistent with, the disclosure can take advantage of this balance of high thermal conductivity and acceptable optical transmissivity levels.

Referring again to the LED lamp 100*a* depicted in exemplary form in FIG. 1, the LED sources 40 can be any of a variety of LED light source types including but not limited to high-power LED lamps, miniature LED lamps, bi-color LEDs, tri-color LEDs, RGB LEDs, digital RGB LEDs, filament LEDs, and others. Those with ordinary skill in the field of the disclosure can recognize the type(s) of LEDs to select for LED sources 40, depending on the application for the LED lamp 100*a*. However, given the enhanced thermal conductivity capabilities of the LED lamp 100*a* with marginal to no impact on optical transmissivity, certain embodiments of the LED lamp 100*a* can employ higher power LED sources 40 than conventional lamps for the same or a similar application. For instance, an LED lamp 100*a* configured for an exterior mirror puddle lamp with a thermal conductivity of at least 2 W/m*K can employ LED sources 40 producing at least 25% more lumens than LED sources employed in a conventional LED lamp arrangement. Further, in other aspects, the enhanced thermal conductivity capabilities of the LED lamp 100*a* allow it to employ LED sources 40 with similar output levels as LED sources employed in a conventional LED lamp configured for the same or a similar application, but with greater device lifetimes and operational efficiency. This is because the improved thermal conductivity of the LED lamp 100*a* affords it with lower operating temperatures, which will improve the efficiency and lifetime of the LED sources 40.

Referring again to the LED lamp 100*a* depicted in FIG. 1, the housing 30 of the lamp 100*a* can be fabricated from any of a variety of materials including but not limited to polymers, composites, ceramics, metals and metal alloys. Preferably, the housing 30 is electrically insulating as it is coupled to the board 70 in most aspects. For housings 30 fabricated from conductive materials, e.g., metals and alloys, additional insulating layers should be placed between the housing 30 and the board 70. Further, the housing 30 can take on any of a variety of shapes, depending on the application for the LED lamp 100*a*. For example, applications for the LED lamp 100*a* include, but are not limited to, mirror puddle lamps, door puddle lamps, dome lamps, turn signals, footwell lamps, interior courtesy lamps, vanity lamps, center high mount stop lamps (CHMSLs), daytime running lamps (DRLs), glove box lamps, and others. In a preferred aspect, the housing 30 includes an interior reflective layer 32 to maximize the percentage of incident light 110 from the LED sources 40 that exits through the lens 10. Further, certain embodiments of the LED lamp 100*a* possess a housing 30 that includes a plurality of clips (not shown) to hold the lens 10 to the housing 30.

Referring again to the LED lamp 100*a* depicted in FIG. 1, the lamp 100*a* includes a heat sink 50. The heat sink 50 is coupled to the board 70 and functions to dissipate heat from the LED sources 40, typically through a conduction mechanism. In certain implementations of the lamp 100*a*, the heat sink 50 is fabricated from die-cast or extruded aluminum, taking advantage of the relatively high thermal conductivity and low weight of aluminum. In certain aspects of the LED lamp 100*a*, the overall size of the heat sink 50 can be reduced relative to conventional heat sinks employed in conventional LED lamp assemblies. For instance, an LED lamp 100*a* configured for an exterior mirror puddle lamp with a thermal conductivity of at least 2 W/m*K can employ a heat sink 50 that is at least 25% smaller in size than a heat sink employed in a conventional LED lamp arrangement. In another aspect of the LED lamp 100*a*, the heat sink 50 can be omitted from the lamp in view of the enhanced ability of the lamp 100*a* to conduct heat from the LED sources 40 through the lens 10. In a preferred implementation, the LED lamp 100*a* does not employ a heat sink and has a lens 10 that exhibits a thermal conductivity of at least 2 W/m*K with an optical transmissivity of at least 80%.

Referring now to the LED lamp 100*a* and its lens 10, FIGS. 1 and 1A depict the lens 10 over the LED sources 40 and coupled to the housing 30. The lens 10 is generally translucent. In certain aspects, the lens 10 can be tinted, e.g., tinted red for the LED lamp 100*a* configured as a center high mount stop lamp. Further, the matrix 18 of the lens 10 can be fabricated from various polymers, preferably polymeric materials that are amenable to injection molding, have a relatively high impact resistance and/or exhibit a relatively high translucency. In a preferred implementation, the matrix 18 of the lens 10 is fabricated from an acrylic or a polycarbonate. As understood by those with ordinary skill in the field, the lens 10 can take on various shapes, including substantially planar (see FIG. 1) or curved shapes.

Referring now to the lens 10 depicted in FIG. 1A (of the LED lamp 100*a*), it includes a plurality of glass beads 20, each with a metal-containing coating and dispersed in the matrix 18. In general, the plurality of beads 20 should be dispersed within the matrix 18 at a volume fraction sufficient to accord the lens 10 with high thermal conductivity and a limited reduction in its optical transmissivity. In an embodiment, the lens 10 includes a plurality of beads 20 at a volume fraction from about 5% to about 15%. For example, the lens 10 can include beads 20 at a volume fraction of 5%, 6%, 7%, 8%, 9%, 10%, 11%, 12%, 13%, 14%, 15%, and all values between these percentages. The plurality of beads 20 can be dispersed randomly in the lens 10 in certain embodiments, e.g., with some beads 20 touching each other and the remainder of the beads not in direct contact with one another. In other embodiments, the beads 20 can be dispersed in a controlled pattern in certain portions of the lens 10, e.g., at particular locations within the thickness of the lens 10, and at particular regions of the lens 10 consistently through the thickness (see FIG. 2, lens 10). Those with ordinary skill in the field of the disclosure can appreciate how to control the dispersion of the plurality of beads 20 in the lens 10, e.g., by coating an interior surface of a mold with a plurality of beads 20 held in place within the mold with an adhesive or through van der Waal's forces.

Figure 2A:
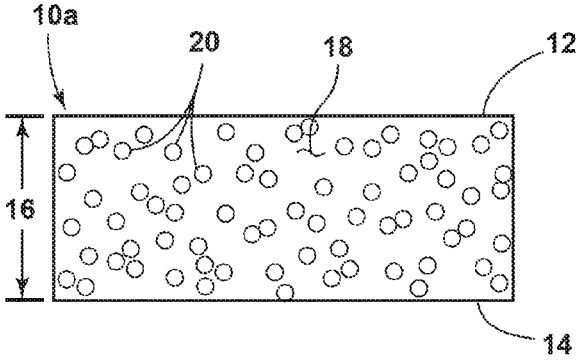
FIG. 2A is an enlarged, cross-sectional schematic view of a portion of the lens of the lamp depicted in FIG. 2 at line IIA-IIA that includes a plurality of glass beads with a metal-containing coating dispersed in a polymeric matrix.
Figure 2B:
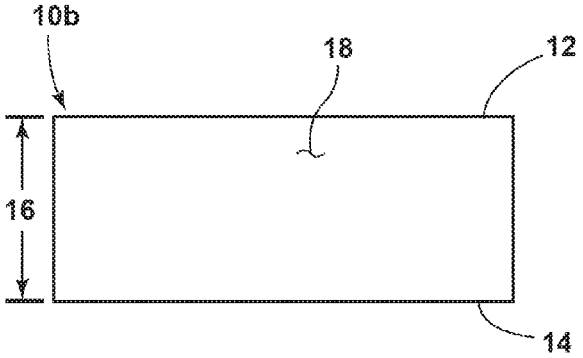
FIG. 2B is an enlarged, cross-sectional schematic view of another portion of the lens of the lamp depicted in FIG. 2 at line IIB-IIB.

Turning now to FIGS. 2, 2A and 2B, an LED lamp 100*b* is depicted with largely the same construction and features as the LED lamp 100*a* embodiment depicted in FIGS. 1 and 1A. Like-numbered elements in common between the LED lamps 100*a* and 100*b* have the same or similar structure with the same or similar function. The primary difference between the lamps 100*a* and 100*b* is that the LED lamp 100*b* includes a lens 10 over the LED sources 40 that is coupled to the housing 30, with only a portion 10*a* of lens 10 including a plurality of glass beads 20, each individual bead 22 (see FIG. 3) having a metal-containing coating 26 (see FIG. 3) and dispersed in a matrix 18. The other portion 10*b* of the lens 10 is configured without any glass beads 20, typically only with a matrix 18. Note that in certain aspects, the portion 10*b* could contain a plurality of filler beads (not shown) at a volume fraction comparable to the plurality of beads 20 in the portion 10*a*.

One advantage of the LED lamp 100*b* depicted in FIGS. 2, 2A and 2B is that its lens 10 employs a plurality of beads 20 only in a portion 10*a* subject to incident light 110 from the LED sources 40. Such an approach can reduce the overall cost of the LED lamp 100*b* given that the plurality of beads 20 can be configured such that each individual bead 22 (see FIG. 3) has a metal-containing coating 26 with a relatively high cost. Further, by limiting the plurality of beads 20 to only a portion 10*a* of the lens 10 in the LED lamp 100*b*, overall weight savings can be obtained relative to the weight of the LED lamp 100*a*. In certain aspects, the portion 10*a* containing the plurality of beads 20 is configured based on a prior understanding of the distribution of the heat flux generated by the LED sources 40 associated with the incident light 110 through the lens 10. That is, prior lab work can focus on an understanding of which portions of the lens 10 are subject to the highest heat flux from the LED sources 40. The LED lamp 100*b* can then be configured with a portion 10*a* containing the plurality of beads 20 in accord with the prior-developed heat flux data.

Figure 3:
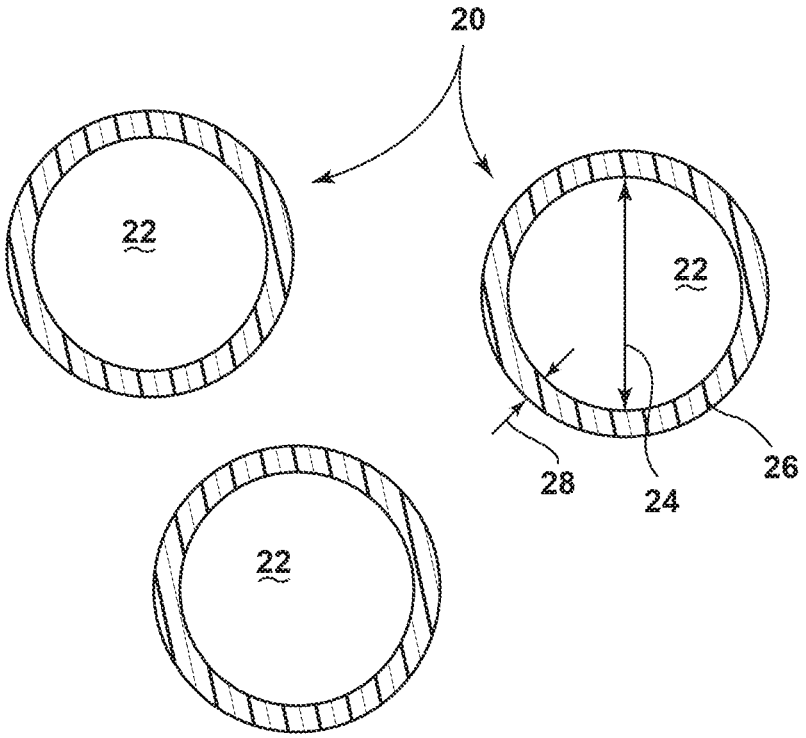
FIG. 3 is an enlarged, cross-sectional schematic of glass beads with a metal-containing coating according to a further aspect of the disclosure.

Referring now to FIG. 3, a plurality of glass beads 20 is depicted in cross-sectional form that can be employed in the LED lamps 100*a*, 100*b* or other LED lamps consistent with the teachings of the disclosure. In certain embodiments, each of the individual beads 22 is fabricated from a borosilicate glass composition, fused silica glass combination, or other glass compositions suitable for a metal-coating and with a refractive index that generally matches the refractive index of the matrix 18. Suitable glass beads 22 for use in the plurality of beads 20 can be obtained from Sovitec Worldwide (e.g., Microperl® glass beads), 3M Company (e.g., 3M™ Glass Bubbles), and others. In certain aspects, each individual bead 22 of the plurality of beads 20 possesses a metal-containing coating 26. It should be understood that certain aspects of the plurality of beads 20 have a significant portion (e.g., at least 90%) of individual beads 22 with a metal-containing coating 26. In general, the individual glass beads are tumbled and polished to ensure a smooth surface for the metal-containing coating 26. Also, in certain aspects, the individual beads 22 are hollow. In certain embodiments, the metal-containing coating 26 includes at least one of nickel, aluminum, silver, copper, indium, brass and other alloys containing these metals.

Referring again to FIG. 3, each of the individual beads 22 possesses a mean diameter 24. The mean diameter 24 can be based on a particle size distribution for the plurality of beads 20. In certain embodiments, the individual glass beads 22 have a mean diameter 24 that ranges from about 3 microns to about 50 microns. In general, most of the individual beads 22 within its particle size distribution have a diameter within the range of about 3 microns to 50 microns. Accordingly, certain implementations of the plurality of beads 22 can possess individual beads 22 with a mean diameter 24 of 3 microns, 4 microns, 5 microns, 6 microns, 7 microns, 8 microns, 9 microns, 10 microns, 15 microns, 20 microns, 25 microns, 30 microns, 35 microns, 40 microns, 45 microns, 50 microns and all mean diameter 24 values between these values.

Again referring to FIG. 3, the metal-containing coating 26 of the individual glass beads 22 can be developed with a thickness 28. In certain aspects, the thickness 28 of the metal-containing coating 26 is from about 250 Angstroms to about 750 Angstroms. In other aspects, the thickness 28 is between about 350 Angstroms and about 650 Angstroms. In a further implementation, the thickness 28 is between about 450 Angstroms and about 550 Angstroms. According to some embodiments, the metal-containing coating 26 is applied in a vacuum chamber to the individual glass beads 22 or chemically coated on the beads 22 according to conventional coating processes, to produce thin metal layers on a glass substrate.

According to a further aspect of the disclosure, a lens for a light-emitting diode (LED) lamp (e.g., LED lamps 100*a*, 100*b* or another LED lamp consistent with the disclosure) is provided that includes: a lens 10 suitable for use with an LED source 40 (or LED sources 40) in which the lens 10 includes glass beads 22 dispersed in a polymeric matrix 18 (see FIGS. 1A and 2A). Further, the beads 22 include a metal-containing coating 26 having a thickness 28 from about 250 to 750 Angstroms (see FIG. 3) and at least one of Ni, Al, Ag, Cu, In and brass. In addition, the lens 10 has a thermal conductivity of at least about 2 W/m*K and an optical transmissivity of at least 80%. In certain aspects of the lens 10, the glass beads 22 are dispersed in a matrix 18 at a volume fraction from about 5% to about 15%, and the matrix 18 is fabricated from an acrylic or a polycarbonate. In addition, certain aspects of the lens 10 can be fabricated with features according to the earlier disclosure associated with the lens 10 (i.e., as a like-numbered element) employed in the LED lamps 100*a* and 100*b*.

The LED lamps (e.g., lamps 100*a* and 100*b*) and lenses (e.g., lens 10) advantageously possess enhanced thermal conductivity with optical transmissivity comparable to those of conventional LED lamps. Notably, the use of metal-coated glass beads within the lens serves to increase the thermal conductivity of the lens, particularly through conduction through the metal coatings of the beads. Further, the glass beads have particularly thin metal-containing coats which do not significantly reduce the overall optical transmissivity of the lens. Accordingly, the LED lamps and lenses of the disclosure provide a configuration to evenly diffuse light for uniform illumination. The LED lamps also have the capability of conducting a large quantity of heat from the LED sources in the lamps through the lens such that reduced size heat sinks can be employed in the lamps or elimination of the heat sinks is possible. Moreover, the lenses of these lamps can be made at a lower cost compared to other currently available conductive plastics (e.g., plastics containing metal flakes), which also suffer from reduced optical transmissivity.

Variations and modifications can be made to the aforementioned structures without departing from the concepts of the present invention. For example, the LED lamps and lenses of the disclosure are not limited to vehicular applications. In certain implementations, for example, the LED lamp and lens configurations of the disclosure could be employed to fabricate LED lamps suitable for residential and commercial lighting. Such LED lamps could be suitable for higher power applications given their enhanced thermal conductivity. Further, these LED lamps could also be employed with higher overall device lifetimes since they can operate at lower temperatures than a conventional counterpart. Such variations and modifications, and other embodiments understood by those with skill in the field within the scope of the disclosure, are intended to be covered by the following claims unless these claims by their language expressly state otherwise.

What is claimed is:

1. A light-emitting diode (LED) lamp, comprising:

an LED source coupled to a housing; and a lens over the source and coupled to the housing, the lens comprising a plurality of glass beads, each with a metal-containing coating and dispersed in a polymeric matrix, wherein the lens has a thermal conductivity of at least about 2 W/m*K and an optical transmissivity of at least 80%.

2. The lamp according to claim 1, wherein the glass beads are hollow.

3. The lamp according to claim 1, wherein the polymeric matrix is selected from the group of materials consisting of acrylics and polycarbonates.

4. The lamp according to claim 3, wherein the glass beads comprise a borosilicate glass composition and the metal-containing coating comprises at least one of Ni, Al, Ag, Cu, In and brass.

5. The lamp according to claim 4, wherein the glass beads have a diameter between about 3 microns and 50 microns and the metal-containing coating is about 250 Angstroms to 750 Angstroms in thickness.

6. The lamp according to claim 5, wherein the plurality of glass beads are dispersed in the matrix at a volume fraction from about 5% to about 15%.

7. The lamp according to claim 6, wherein the lens is characterized by a thermal conductivity of 3 W/m*K and an optical transmissivity of at least 85%.

8. The lamp according to claim 7, wherein the lamp is configured for a vehicular application selected from the group consisting of a center high mount stop lamp, a daytime running lamp, a mirror puddle lamp, a door puddle lamp, a dome lamp, a turn signal, a footwell lamp, and an interior courtesy lamp.

9. The lamp according to claim 7, wherein a portion of the lens is in contact with the LED source.

10. A light-emitting diode (LED) lamp, comprising:

an LED source coupled to a housing; and a lens over the source and coupled to the housing, wherein a portion of the lens comprises a plurality of glass beads, each having a metal-containing coating and dispersed in a polymeric matrix, wherein the lens has a thermal conductivity of at least about 2 W/m*K and an optical transmissivity of at least 80%.

11. The lamp according to claim 10, wherein the polymeric matrix is selected from the group of materials consisting of acrylics and polycarbonates.

12. The lamp according to claim 10, wherein the glass beads are hollow.

13. The lamp according to claim 11, wherein the glass beads comprise a borosilicate glass composition and the metal-containing coating comprises at least one of Ni, Al, Ag, Cu, In and brass.

14. The lamp according to claim 13, wherein the glass beads have a diameter between about 3 microns and 50 microns and the metal-containing coating is about 250 Angstroms to 750 Angstroms in thickness.

15. The lamp according to claim 14, wherein the plurality of glass beads are dispersed in the matrix at a volume fraction from about 5% to about 15%.

16. The lamp according to claim 15, wherein the lens is characterized by a thermal conductivity of 3 W/m*K and an optical transmissivity of at least 85%.

17. The lamp according to claim 16, wherein the lamp is configured for a vehicular application selected from the group consisting of a center high mount stop lamp, a daytime running lamp, a mirror puddle lamp, a door puddle lamp, a dome lamp, a turn signal, a footwell lamp, and an interior courtesy lamp.

18. The lamp according to claim 16, wherein the outer portion of the lens is in contact with the LED source.

19. A lens for a light-emitting diode (LED) lamp, comprising:

a lens for an LED source comprising glass beads dispersed in a polymeric matrix, the beads comprising a metal-containing coating having a thickness from about 250 to 750 Angstroms and at least one of Ni, Al, Ag, Cu, In and brass, wherein the lens has a thermal conductivity of at least about 2 W/m*K and an optical transmissivity of at least 80%.

20. The lens according to claim 19, wherein the glass beads are dispersed in the matrix at a volume fraction from about 5% to about 15% and the matrix is selected from the group of materials consisting of acrylics and polycarbonates.

* * * * *